US005125523A

United States Patent [19]

Kulper

[11] Patent Number: 5,125,523

[45] Date of Patent: Jun. 30, 1992

[54] CONTAINER FOR STORAGE AND TRANSPORT OF BEVERAGE CANS

[76] Inventor: Robert A. Kulper, 811 Maucker Rd., Cedar Falls, Iowa 50613

[21] Appl. No.: 543,610

[22] Filed: Jun. 25, 1990

[51] Int. Cl.[5] ..... B65D 43/24

[52] U.S. Cl. ..... 220/4.23; 220/338

[58] Field of Search ..... 220/338, 340, 4.23, 220/4.22

[56] References Cited

U.S. PATENT DOCUMENTS

| | | | |
|---|---|---|---|
| 2,732,581 | 1/1956 | Heck | 220/338 |
| 3,077,282 | 2/1963 | Eggers | 220/338 |
| 3,087,192 | 4/1963 | Hertzke | 220/338 |
| 3,960,290 | 6/1976 | Yake et al. | 220/338 |
| 3,994,416 | 11/1976 | Mulligan | 220/338 |
| 4,925,059 | 5/1990 | Harvey et al. | 220/338 |

*Primary Examiner*—Joseph Man-Fu Moy
*Attorney, Agent, or Firm*—Allan L. Harms

[57] ABSTRACT

A storage and transportation receptacle for empty recyclable beverage cans. A pair of open sided frames for receiving upright beverage cans can be hingedly linked as desired and then folded to provide a carrying case. An optional flexible cover may be placed over the open side of a frame to retain cans in the frame when a single frame is used alone.

15 Claims, 1 Drawing Sheet

FIG. 1
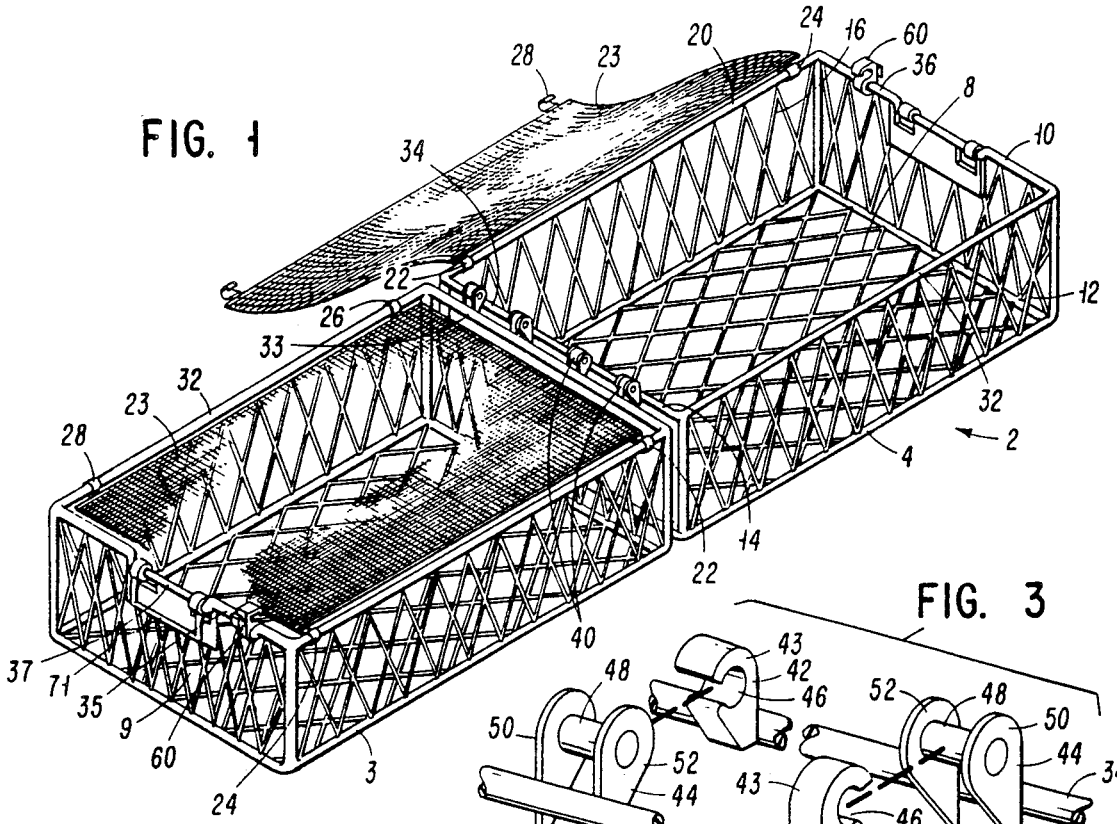
FIG. 3
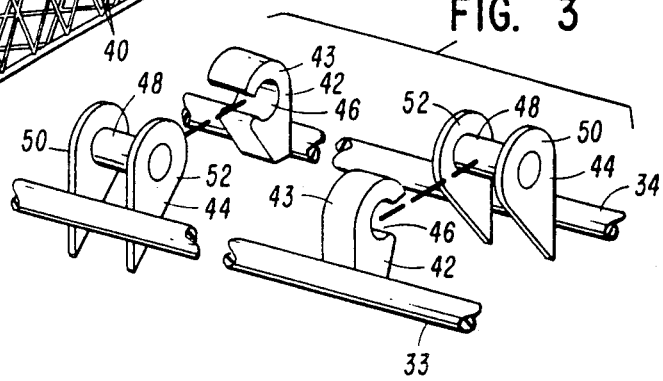
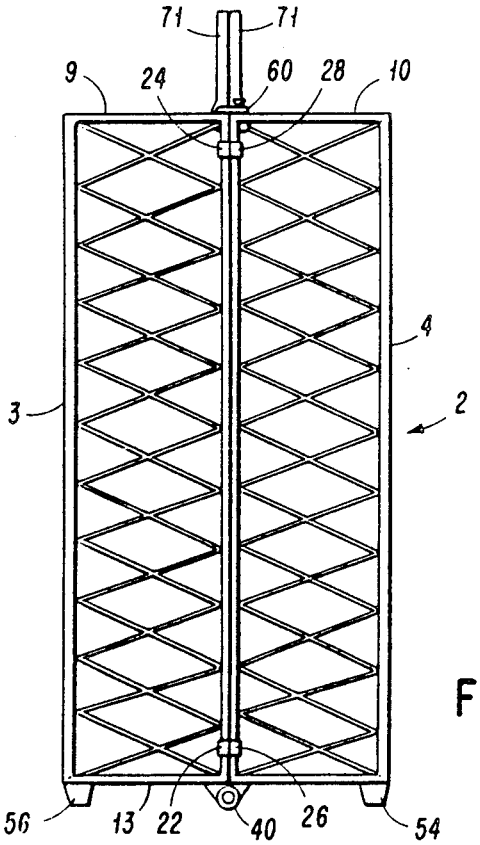
FIG. 2
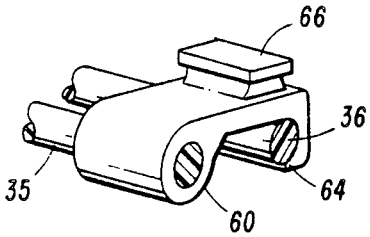
FIG. 4

CONTAINER FOR STORAGE AND TRANSPORT OF BEVERAGE CANS

BACKGROUND OF THE INVENTION

With the increase in consumer and environmental awareness, several states have legislated deposit laws to encourage the recycling of soft drink cans. In addition, public environmental concern has led to increasing interest in the area of container recycling. Furthermore, the impact of refuse on our landfill facilities has brought about increased efforts to sort trash and refuse to allow efficient collection of aluminum cans and glass containers for recycling.

The development of aluminum can deposit laws has led the public to save and store empty beverage containers and to be confronted with the problems of inconvenient storage and transport of numbers of cans. Typically, consumers have been carrying the empty can back to retainers or recyclers in various paper and plastic bags, in the paperboard containers in which they were purchased, or on paperboard traps provided by bottlers when the canned soft drinks are shipped from the factory. The usual cardboard tray is sized to receive 24 cans standing upright and is provided with a one- or two-inch upstanding flange surrounding the floor of the tray. Due to the negligible mass of each individual empty aluminum can, empty cans placed on such a tray are subject to easily toppling off the tray or being blown therefrom by a gust of wind.

SUMMARY OF THE INVENTION

The invention relates to carrying cases for recyclable aluminum cans. A pair of substantially identical frames which may be conveniently interconnected is provided, each frame having an open side, a floor and sidewalls. Each frame is dimensioned to facilitate the placement of a plurality of aluminum beverage cans therein with each can resting in an upright position upon the floor of the frame. A flexible maze is provided to be movable to an overlying position relative to the aluminum cans, generally providing a permeable closure means for the open side of the frame.

Hinge elements are provided upon one sidewall of each frame, the hinge elements depending from one sidewall at the free edge thereof. The hinge elements are so arranged to enable the mating thereof with hinge elements of another of the frames. The hinge elements may be brought into mating relationship by the proper adjacent positioning of the pair of frames. When two units have been brought into adjacency at their hinge-carrying-sidewalls, the hinge elements can be mated and the units may be pivoted about the axes of the hinge elements. When the open side of one frame is brought into abutting interrelationship with the open side of another frame, latching elements provided on the sidewalls of one unit may engage the sidewalls of the opposing unit and interconnect thereto, thereby creating a single invention assembly. Handles are provided upon the invention to permit easy carrying of the units.

One object of the invention is to provide a convenient carrying case for recyclable beverage cans.

Another object of the invention is to provide a storage receptacle for receiving recyclable beverage cans.

Another object of the invention is to provide a storage receptacle system whereby pairs of the receptacle may be selectively secured together in a common unit.

These and other objects of the invention will become apparent from examination of the detailed description which follows.

DESCRIPTION OF THE DRAWING FIGURES

FIG. 1 is a perspective view of the invention in position to receive aluminum cans.

FIG. 2 is a front elevation of the invention in its closed position.

FIG. 3 is an enlarged perspective view of the hinge elements of the invention.

FIG. 4 is an enlargement in perspective of a latch member of the invention.

DETAILED DESCRIPTION OF THE INVENTION

Referring to the drawings and in particular to FIG. 1, the invention 2 is shown in its first position for receiving the placement of objects therein. Invention 2 comprises frames 3 and 4, which are substantially identical in structure. Frames 3 and 4 are shown in abutment in FIG. 1 through they may be used independently of each other. Each of frames 3 and 4 is provided with cover 23 which is shown in an open position on frame 4 and in a closed position on frame 3. Except where required for clarity, like elements on frames 3 and 4 will be identified identically.

In FIG. 2, invention 2 is shown in its closed position ready to be moved by a user lifting invention 2 by handles 71. It can be seen that in this position, invention 2 will rest on feet 54 and 56 and hinges 40. Sidewall 9 of frame 3 and sidewall 10 of frame 4 abut at their respective free edges and handles 71 are rotated into engagement to form a single handle assembly.

In the interest of clarity, references to frame 4 only will follow except where differentiation from frame 3 is necessary.

Frame 4 comprises an open-sided polyhedron having a floor 8 and a plurality of sidewalls 10, 12, 14 and 16. In the preferred embodiment, frame 4 is of a generally rectangular configuration with sidewalls 10, 12, 14 and 16 each being orthogonally mounted to floor 8. Other shapes of frames 3 and 4 are contemplated. In the preferred embodiment, sidewalls 10, 12, 14 and 16 extend from floor 8 such that their height slightly exceeds the height of a common twelve ounce aluminum beverage can. If the invention were to be used to carry other objects, the height of sidewalls 10, 12, 14 and 16 would be selected to exceed the largest dimension of the goods to be placed in the invention. In the preferred embodiment, sidewalls 10, 12, 14 and 16 and floor 8 are constructed of an open gridwork for ease of cleaning. However, solid sheet material may also be used for such components.

Beverage cans, including those made from aluminum, may be placed within frame 4 such that they will rest on floor 8, preferably in an upstanding position. When frames 3 and 4 are sufficiently filled with beverage cans, invention 2 may be moved to its closed position, as depicted in FIG. 2.

Each of frames 3 and 4 may be used independently of the other. Optional cover 23 is selectively movable to enclose the contents of frame 4 and to retain such contents therewithin when frame 4 is to be moved independently. In the preferred embodiment, cover 23 comprises a flexible sheet attached pivotally to rail 20 of sidewall 16 by bands 22 and 24. Clasps 26 and 28 are provided on free end 30 of cover 23 to selectively engage rail 32 of sidewall 12 to retain cover 23 in place generally overlying floor 8. In the preferred embodiment, cover 23 is constructed of a mesh of netting material although other flexible materials may be used. Because an individual aluminum beverage can is of small mass, cover 23 need only be of sufficient strength to provide the necessary retentive function when frame 4 is moved to a position to rest on one of sidewalls 10, 12, 14 or 16.

Further referring to FIG. 1 and in particular to frame 3 as shown in FIG. 1, handle 71 can be seen attached to sidewall 9 of frame 3. Handle 71 is pivotal about rail 35 at indented portion 37 thereof. Cover 23 is depicted in the closed position on frame 3 with clasps 26 and 28 engaged upon rail 32 of frame 3. A latch member 60 is fixed upon rail 35 of sidewall 9 of frame 3. Similarly, a latch member 60 is fixed to rail 36 of sidewall 10 of frame 4. When abutted as shown in FIG. 1, frames 3 and 4 are joined at hinges 40.

Referring now to FIG. 3, the details of the features of hinges 40 can be seen. FIG. 3 discloses an enlargement of cut-away parts of rail 33 of sidewall 13 of frame 3 and of rail 34 of sidewall 14 of frame 4. Each of rails 33 and 34 has mounted thereto both pin elements 44 and pin receiving elements 42 in spaced apart relationship therealong. Each pin element 44 comprises bracket members 50 and 52 having a pin 48 mounted transversely therebetween. Because of the substantial identicality of frames 3 and 4, a pin element 44 of one of frames 3 and 4 will align with and be matable to a pin receiving element 42 of the other of frames 3 and 4 when frames 3 and 4 are properly aligned and positioned adjacently at their sidewalls 13 and 14 respectively. In the preferred embodiment, pin elements 44 alternate along rails 33 and 34 with pin receiving elements 42. A pin element 44 engaged with a pin receiving element 42 comprises a hinge 40 as seen in FIGS. 1 and 2.

Each pin receiving element comprises a curved section 43 formed to create a generally cylindrical recess 46 into which pin 48 of an opposing pin element 44 may be introduced. As pin receiving element 42 is rotated about the axis of pin 48 of the complementary pin element 44, curved section 43 becomes captured between pin 48 and the rail 33 or 34 on which pin element 44 is mounted, thereby retaining pin receiving element 42 to pin element 44 to create hinge 40.

Pin receiving element 44 is sized appropriately such that brackets 50 and 52 of pin element 44 depend from sidewall 14 a distance generally equal to the height of each of feet 54 and 56, seen in FIG. 2, such that brackets 50 and 52 provide protrusions on which frame 4 may rest cooperatingly with foot 54 when frame 4 is placed with sidewall 10 at the top.

Referring now to FIG. 4, an enlargement of latch member 60 is disclosed. In this figure, latch member 60 is pivotally fixed to rail 35 of sidewall 9 of frame 3. Free end 62 of latch member 60 is provided with lip 64 which selectively catches rail 36 of sidewall 10 of frame 4. Knob 66 is formed on latch member 60 to provide means for the user to grasp latch member 60 to remove it from its engagement with rail 36.

OPERATION OF THE INVENTION

The user of invention 2 will place empty recyclable items such as beverage cans within frame 4 or frame 3 or both. When movement of a partially or fully filled frame 4 is desired, cover 23 may be disposed to overlie the contents of frame 4. With cover 23 so disposed, frame 4 may be moved to an upright position with cover 23 retaining the contents within frame 4.

If two frames are used, as shown in FIG. 1, frame 3 will be placed adjacent to frame 4 with frames 3 and 4 aligned such that pin receiving elements 42 engage pin elements 44. When frames 3 and 4 are then rotated about the axis of pins 48 of pin elements 44, pin receiving elements 42 cooperate with pin elements 44 to provide hinges 40. When frames 3 and 4 are fully pivoted such that sidewalls 9 and 10 of frames 3 and 4 respectively are in edgewise abutment, latch member 60 are available to selectively lock frames 3 and 4 in abutment. Handles 71 may then be swiveled upon rail 35 of frame 3 and rail 36 of frame 4 to engage each other and be utilized to lift and carry invention 2.

In practice it is found that a desirable form of the invention is dimensioned to receive 24 twelve-ounce recyclable cans with each can standing upright on floor 8 of frame 4. For such cans, inside dimensions of frame 4 are preferably approximately 15.5 inches by 10.5 niches. The preferable height of sidewalls 10, 12, 14 and 16 would be approximately 5.0 inches.

The user of the invention 2 would typically disconnect frame 3 from frame 4 and fill each of the frames with cans whereupon the frames would be placed side by side, the hinge elements joined and the frames pivoted together to provide the upright container as shown in FIG. 2. In locations where deposit markings carried on tops of cans are to be checked, frames 3 and 4 can be pivoted apart and easy inspection of the cans for deposit markings can be made.

Having described the invention, I claim:

1. Apparatus for storage and transportation of empty beverage cans, the invention comprising a pair of generally identical frames each having an open side, each of said frames having a plurality of sidewalls and a floor, each of said frames having protruding elements fixed to a sidewall thereof, said protruding elements of one of said frames selectively interconnectable with said protruding elements of the other of said frames to provide hinge means between said frames, said protruding elements comprising pin elements and pin receiving elements, each pin receiving element having a curved free end with an open recess thereupon, said pin elements receivable within said recesses when said sidewalls of said frames having said protruding elements are proximate and substantially parallel, said pin elements abutted to said recesses but no retained thereto when said first sidewalls of said frames are substantially parallel.

said curved free ends of said pin receiving elements rotate about said pin elements as said frames are pivoted about said pin elements, said free ends are captured between said pin elements and said sidewall as said frames are pivoted about said pin elements to a position where said sidewalls having said protruding elements are substantially nonparallel.

2. The invention of claim 1 wherein said sidewalls extend from said floor in excess of the height of said beverage cans.

3. The invention of claim 1 wherein a latch member provided on at least one of said frames to selectively engage the other of said frames when said frames about at the open sides thereof, said latch member selectively retaining said frames in abutting relationship.

4. The invention of claim 1 wherein handle means provided on at least one of said frames.

5. The invention of claim 1 wherein each of said frames having a selectively removable cover overlying and spaced apart from the floor thereof.

6. In a container for carrying empty beverage cans, the invention comprising:

a pair of identical frames having a plurality of sidewalls joined by a planar floor and having an open side opposite the floor, one of said sidewalls being a first sidewall having hinge elements depending from the free edge thereof, said frames pivotable about the hinge elements when the hinge elements of one of said frames are engaged with the hinge elements of the other of said frames, each hinge element of one of said frames being associated with a hinge element of the other of said frames, each hinge element being abuttable with the hinge element with which it is associated when said first sidewalls of said frames are generally parallel, said abuttable hinge elements abutted together, having no interconnection therebetween, when said first sidewalls are generally parallel each of said hinge elements being fixed in hinging engagement only when said frames are pivoted relative one to the other about the axis of said engaged hinge elements to a position where the planes of said first sidewalls are nonparallel.

7. The invention of claim 6 wherein said hinge elements comprise a multiplicity of pin bearing elements and pin receiving elements, alternatingly arranged along said free edges of said sidewalls, with each pin bearing element engagable with a corresponding pin receiving element when said first side walls of said frames are placed in generally parallel proximity, each pin bearing element comprising a pin supported by brackets and spaced apart from said free edge of said sidewalls, each pin receiving element having a cylindrical recess therealong into which the pin of a pin bearing element may be freely received.

8. The invention of claim 7 wherein each pin receiving element having a curved free end which is rotatable about a pin of a corresponding pin bearing element when the pin of said pin bearing element is engaged with a corresponding pin receiving element and said first sidewalls of said frames are rotated about the axis of said hinge elements, the free ends of said pin receiving elements being captured between said pins and said free edges of said sidewalls when said first sidewalls are rotated about the axis of said hinge elements to a position of substantial nonparallel interrelationship.

9. The invention of claim 6 wherein each frame having a second sidewall said first sidewall and having thereon a pivotable handle member, each of said handle members being pivotable into engagement with the handle member of the other frame when said frames are pivoted about the axis of said hinge elements into position with the edges of said side walls in abutment.

10. The invention of claim 6 wherein each of said frames having a flexible cover element fixed to a side wall thereof and disposable selectively over the open side thereof and selectively attachable to a side wall opposing the side wall to which said cover is mounted.

11. Apparatus for storage and transport of beverage containers, the invention comprising a pair of frames, each having a floor, sidewalls and an open side, said sidewalls and floor of each frame defining a container-receiving space therein, each frame having at least one sidewall having a plurality of hinge elements depending from the free edge thereof, each hinge element of one frame selectively linkable with a complementary hinge element of the other frame only when said at least one sidewall of one frame is substantially parallel to the other at least one sidewall of the other frame, said hinge elements comprising pin elements and pin receiving elements, each of said pin elements receivable by a pin receiving element, each pin element comprising paired bracket members with a transverse pin therebetween, each pin receiving element having a curved free end with a cylindrical recess thereupon, each pin element receivable within a recess of a pin receiving element, said pin elements being unretainedly abutted to said recesses when said at least one sidewall of one frame is substantially parallel and proximate to said at least one sidewall of the other frame, said curved free end on said pin receiving elements retained by said pin elements only when said frames are pivoted about the pins of said pin elements and said at least one wall of one frame is substantially nonparallel to said at least one wall of the other frame.

12. The invention of claim 11 wherein each of said frames having a handle member pivotably mounted upon a sidewall thereof, the handle member of one frame selectively disposable to engage with the handle member of the other frame.

13. The invention of claim 11 wherein each frame having at least one latch member mounted thereto, each of said latch members engagable with the other of said frames, said frames retained in abutment at the edges of the sidewalls thereof when said latch member engage said frames.

14. The invention of claim 11 wherein each frame having a cover mounted thereto and selectively disposable to enclose the open side of the frame.

15. The invention of claim 11 wherein said frames having supporting feet mounted to said at least one sidewall, said feet depending from said sidewall a distance generally equal to the distance said hinge elements depend from said at least one sidewall.

* * * * *